US009964871B2

(12) United States Patent
Sakimura et al.

(10) Patent No.: US 9,964,871 B2
(45) Date of Patent: May 8, 2018

(54) ELECTROPHOTOGRAPHIC PHOTORECEPTOR

(71) Applicant: Konica Minolta, Inc., Tokyo (JP)

(72) Inventors: Tomoko Sakimura, Hino (JP); Toyoko Shibata, Zama (JP); Masanori Yumita, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days. days.

(21) Appl. No.: 15/359,862

(22) Filed: Nov. 23, 2016

(65) Prior Publication Data

US 2017/0168406 A1 Jun. 15, 2017

(30) Foreign Application Priority Data

Dec. 11, 2015 (JP) ..... 2015-242405

(51) Int. Cl.

| | |
|---|---|
| ***G03G 5/00*** | (2006.01) |
| ***G03G 5/147*** | (2006.01) |
| ***G03G 5/047*** | (2006.01) |
| ***G03G 5/06*** | (2006.01) |
| ***G03G 5/082*** | (2006.01) |
| ***G03G 5/14*** | (2006.01) |

(52) U.S. Cl.

CPC ..... *G03G 5/1476* (2013.01); *G03G 5/047* (2013.01); *G03G 5/0696* (2013.01); *G03G 5/082* (2013.01); *G03G 5/142* (2013.01); *G03G 5/14704* (2013.01); *G03G 5/14726* (2013.01); *G03G 5/14786* (2013.01); *G03G 5/14791* (2013.01)

(58) Field of Classification Search

CPC ..... G03G 5/1476; G03G 5/14786
USPC ..... 430/66
See application file for complete search history.

(56) References Cited

U.S. PATENT DOCUMENTS 4,996,125 A * 2/1991 Sakaguchi ..... G03G 5/005 430/66

FOREIGN PATENT DOCUMENTS

| | | | |
|---|---|---|---|
| JP | 2011-242574 | A | 12/2011 |
| JP | 2012078620 | A | 4/2012 |
| JP | 2012128324 | A | 7/2012 |
| JP | 2015-028613 | A | 2/2015 |
| JP | 2015028613 | A | 2/2015 |
| JP | 2015-184489 | A | 10/2015 |

OTHER PUBLICATIONS

Notice of Reasons for Rejection dated Feb. 20, 2018 from corresponding Japanese Patent Application No. JP 2015-242405 and English translation.

* cited by examiner

*Primary Examiner* — Mark A Chapman
(74) *Attorney, Agent, or Firm* — Lucas & Mercanti, LLP

(57) ABSTRACT

An electrophotographic photoreceptor includes: a conductive support; a photosensitive layer disposed on the conductive support; and a protective layer disposed on the photosensitive layer, wherein the protective layer is formed of a polymerized and cured product of a radically polymerizable composition containing a radically polymerizable monomer, a perfluoropolyether compound having a radically polymerizable group, and metal oxide fine particles having a radically polymerizable group.

6 Claims, 1 Drawing Sheet

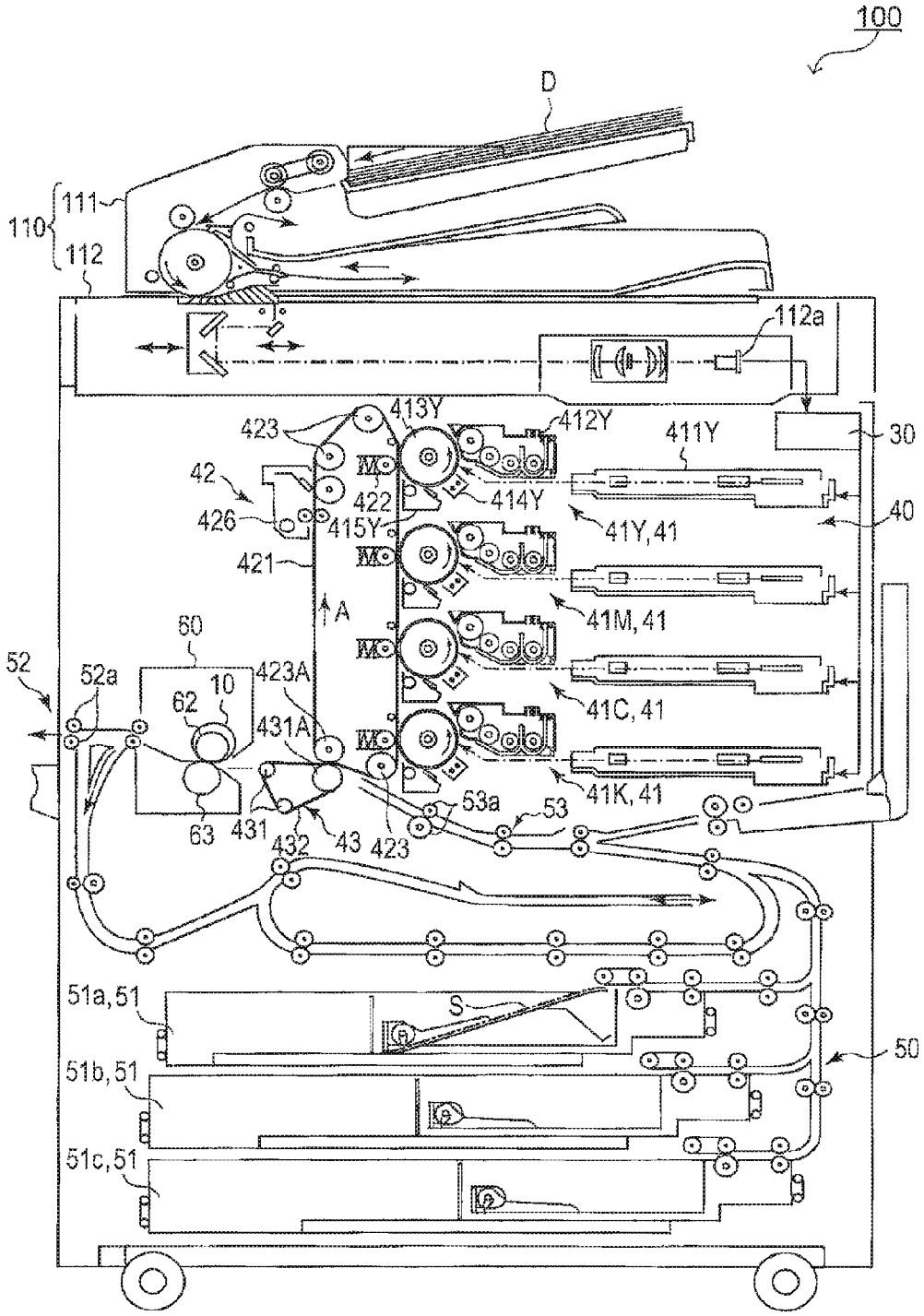
100
D
110
111
112
112a
30
40
413Y
412Y
411Y
423
42
422
414Y
426
415Y
41Y, 41
421
A
41M, 41
60
52
52a
10
62
423A
41C, 41
431A
41K, 41
53a
53
63
431
432
43
423
51a, 51
S
50
51b, 51
51c, 51

ELECTROPHOTOGRAPHIC PHOTORECEPTOR

The entire disclosure of Japanese Patent Application No. 2015-242405 filed on Dec. 11, 2015 including description, claims, drawings, and abstract are incorporated herein by reference in its entirety.

BACKGROUND OF THE INVENTION

Field of the Invention

The present invention relates to an electrophotographic photoreceptor.

Description of the Related Art

In recent years, it has become mainstream to use toner having a small particle size in an electrophotographic image forming apparatus as a demand for a high-definition and high-quality image has increased. Toner having a small particle has a great adhesivity to the surface of an electrophotographic photoreceptor (hereinafter, also referred to as the "photoreceptor"). Hence, it is required to increase the abutting pressure of the cleaning blade to the photoreceptor in order to realize high cleaning property, and as a result, the surface of the photoreceptor is worn by the repeated use of the photoreceptor in some cases.

As a means to decrease the adhesivity between the surface of the photoreceptor and the toner and to increase the cleaning property, it has been known to add a fluorine-based material such as fluorine-based fine particles or a fluorine-based lubricant to the protective layer of a photoreceptor. However, the hardness of the surface of the protective layer is likely to be insufficient when the amount of the fluorine-based material added is great.

In addition, a fluorine-based material is likely to migrate to the surface of the film of a coating material for protective layer in the coating material. For this reason, the fluorine-based material tends to be present only on the surface and in the vicinity thereof of the photoreceptor (protective layer) at a high concentration. Hence, in the case of using the photoreceptor in an image forming apparatus, high cleaning property is exhibited in the beginning but the cleaning property is insufficient in some cases when the surface of the photoreceptor is shaved in association with repeated use of the photoreceptor.

In the techniques for improving both the wear resistance and cleaning property of a photoreceptor, for example, a protective layer formed of the polymerized and cured product of a radically polymerizable composition containing a urethane acrylate having a perfluoropolyether moiety, a tri- or higher functional radically polymerizable monomer, and a radically polymerizable compound having a charge transport structure is known (for example, see JP 2012-128324 A).

In addition, in the techniques for maintaining both the toner releasing property and low wear property of the surface even after printing a great number of sheets, for example, a protective layer which contains perfluoropolyether and has a proportion of the number of fluorine atoms to the number of carbon atoms of 0.10 or more and 0.40 or less is known (for example, see JP 2015-028613 A).

In addition, in the techniques for enhancing the hardness and scratch resistance of the surface of a photoreceptor and the durability of the photoreceptor, a protective layer formed through polymerization and crosslinking of a polymerizable compound with a surface-treated metal oxide is known (for example, see JP 2012-078620 A).

However, even in the case of using the protective layers described in JP 2012-128324 A and JP 2015-028613 A, there is a case in which a decrease in properties such as wear resistance or scratch resistance due to the mechanical strength is observed when the content of the perfluoropolyether compound is high and high cleaning property is not sufficiently maintained when the photoreceptor is repeatedly used when the content of the perfluoropolyether compound is low. Hence, there is room for investigation in the photoreceptor of the related art from the viewpoint of sufficiently exerting the wear resistance, the scratch resistance, and the cleaning property.

SUMMARY OF THE INVENTION

An object of the present invention is to provide an electrophotographic photoreceptor which exhibits excellent wear resistance, scratch resistance, and cleaning property and can exert these properties over a long period of time.

To achieve the abovementioned object, according to an aspect, an electrophotographic photoreceptor reflecting one aspect of the present invention comprises: a conductive support; a photosensitive layer disposed on the conductive support; and a protective layer disposed on the photosensitive layer, wherein the protective layer is formed of a polymerized and cured product of a radically polymerizable composition containing a radically polymerizable monomer, a perfluoropolyether compound having a radically polymerizable group, and metal oxide fine particles having a radically polymerizable group.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 1 is a diagram schematically showing an example of the configuration of an image forming apparatus according to an embodiment of the present invention.

DESCRIPTION OF THE PREFERRED EMBODIMENTS

Hereinafter, an embodiment of the present invention will be described with reference to the drawings. However, the scope of the invention is not limited to the illustrated examples.

The electrophotographic photoreceptor (photoreceptor) according to the present embodiment has a conductive support, a photosensitive layer disposed on the conductive support, and a protective layer disposed on the photosensitive layer.

The conductive support is a member which can support the photosensitive layer and exhibits conductivity. Examples of the conductive support may include a metal drum or sheet, a plastic film having a laminated metal foil, a plastic film having a deposited film of a conductive material, a metal member or a plastic film having a conductive layer formed by applying a coating material composed of a conductive material or the conductive material and a binder resin, and paper. Examples of the metal may include aluminum, copper, chromium, nickel, zinc, and stainless steel, and examples of the conductive material may include the metals, indium oxide, and tin oxide.

The photosensitive layer is a layer for forming an electrostatic latent image of a desired image on the surface of the photoreceptor by exposure to be described later. The photosensitive layer may be a single layer or may be constituted by a plurality of layers laminated. Examples of the photosensitive layer may include a single layer containing a charge transporting compound and a charge generating compound and a laminate of a charge transport layer containing a charge transporting compound and a charge generating layer containing a charge generating compound.

The protective layer is a layer which protects the photosensitive layer and constitutes the surface of the photoreceptor while being disposed on the photosensitive layer. The protective layer is formed of a polymerized and cured product of a radically polymerizable composition containing a radically polymerizable monomer, a perfluoropolyether compound having a radically polymerizable group, and metal oxide fine particles having a radically polymerizable group. In other words, the protective layer is constituted by an integral polymer obtained through radical polymerization of a radically polymerizable monomer, and a perfluoropolyether compound and metal oxide fine particles are dispersed in the protective layer. The perfluoropolyether compound and the metal oxide fine particles are both bonded to the polymer by a covalent bond through radical polymerization.

In addition, the photoreceptor may further include another configuration other than the conductive support and the photosensitive layer in a range in which the effect according to the present embodiment is obtained. Examples of another configuration may include an intermediate layer. The intermediate layer is, for example, a layer that is disposed between the conductive support and the photosensitive layer and has a barrier function and an adhesion function.

The photoreceptor can be configured in the same manner as a known organic photoreceptor except the layer constituting the surface thereof, and for example, it can be configured so that the portions other than the protective layer are the same as those in the photoreceptor described in JP 2012-078620 A. In addition, the protective layer can also be configured as described in JP 2012-078620 A except that the material is different.

The protective layer is a polymerized and cured product of a radically polymerizable composition as described above, and the radically polymerizable composition contains a radically polymerizable monomer, a perfluoropolyether compound having a radically polymerizable group, and metal oxide fine particles having a radically polymerizable group. These may all be one kind or more kinds.

[Radically Polymerizable Monomer]

The radically polymerizable monomer is a compound which has a radically polymerizable group and forms a resin to be generally used as a binder resin of a photoreceptor through radical polymerization (curing) as the radically polymerizable monomer is irradiated with an active ray such as ultraviolet light, visible light, or an electron beam or energy is applied thereto by heating or the like. Examples of the radically polymerizable monomer may include a styrene-based monomer, an acrylic monomer, a methacrylic monomer, a vinyl toluene-based monomer, a vinyl acetate-based monomer, and an N-vinyl pyrrolidone-based monomer, and examples of the binder resin may include polystyrene and polyacrylate.

The radically polymerizable group is a group which has a carbon-carbon double bond and is radically polymerizable. The radically polymerizable group is even more preferably an acryloyl group ($CH_2{=}CHCO{-}$) or a methacryloyl group ($CH_2{=}C(CH_3)CO{-}$) from the viewpoint of being curable with a small amount of light or in a short time.

Specific examples of the radically polymerizable monomer may include the following compounds M1 to M15. In the following formulas, R represents an acryloyl group, R' represents a methacryloyl group.

[Chem. 1]

M1

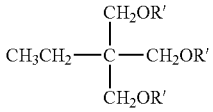

M2

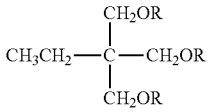

M3

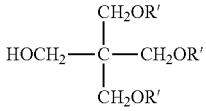

M4

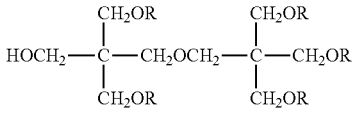

M5

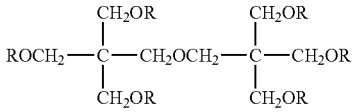

M6

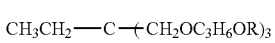

M7

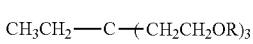

M8

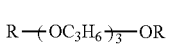

[Chem. 2]

M9

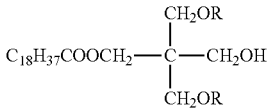

M10

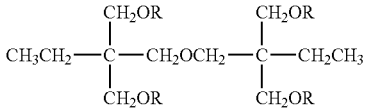

M11

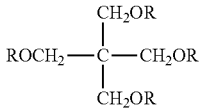

M12

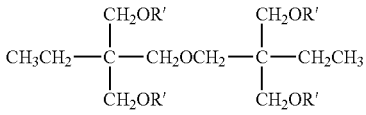

-continued

M13

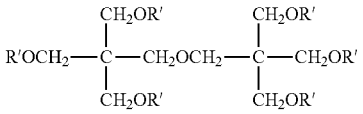

M14

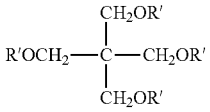

M15

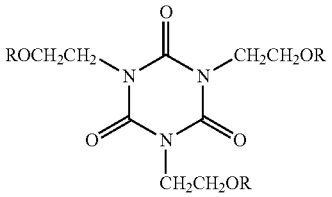

The radically polymerizable monomer compounds are known and can be available as commercial products as well. The radically polymerizable monomer is preferably a compound having 3 or more radically polymerizable groups from the viewpoint of forming a highly hard protective layer having a high crosslinking density.

[Perfluoropolyether Compound Having Radically Polymerizable Group]

The perfluoropolyether compound (hereinafter, also referred to as "PFPE") in the perfluoropolyether compound having a radically polymerizable group (hereinafter, also referred to as the "radically polymerizable PFPE") is an oligomer or polymer having perfluoroalkylene ether as a repeating unit. Examples of the structure of the perfluoroalkylene ether repeating unit may include structures of perfluoromethylene ether, perfluoroethylene ether, and perfluoropropylene ether repeating units. Among them, it is preferable that the perfluoropolyether has a repeating structural unit 1 represented by the following formula (a) or a repeating structural unit 2 represented by the following formula (b).

[Chem. 3]

(a)

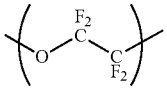

(b)

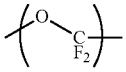

In a case in which the PFPE has the repeating structural unit 1 or the repeating structural unit 2, the number of repetitions m of the repeating structural unit 1 and the number of repetitions n of the repeating structural unit 2 are each an integer 0 or more, and they are $m+n \geq 1$.

In addition, in a case in which the PFPE has both of the repeating structural unit 1 and the repeating structural unit 2, the repeating structural unit 1 and the repeating structural unit 2 may form a block copolymer structure or a random copolymer structure.

The weight average molecular weight Mw of the PFPE is preferably 100 or more and 8,000 or less and more preferably 500 or more and 5,000 or less.

The number of the radically polymerizable groups belonging to the radically polymerizable PFPE is 1 or more and preferably 2 or more. In a case in which the radically polymerizable PFPE has two or more radically polymerizable groups, the position of the radically polymerizable groups in the PFPE may be one terminal or both terminals and the two or more radically polymerizable groups may be bonded to one terminal or both terminals.

Among them, the radically polymerizable PFPE having 4 or more radically polymerizable groups has more reactive sites with the radically polymerizable monomer and radically polymerizable metal oxide fine particles to be described later. Hence, the radically polymerizable PFPE having 4 or more radically polymerizable groups is even more preferable from the viewpoint of enhancing the wear resistance and cleaning property of the photoreceptor.

The radically polymerizable group is a group which has a carbon-carbon double bond and is radically polymerizable as that of the radically polymerizable monomer. The radically polymerizable group of the radically polymerizable PFPE may be the same as or different from that of the radically polymerizable monomer. In addition, a plurality of radically polymerizable groups belonging to the radically polymerizable PFPE may also be the same as or different from one another. The radically polymerizable functional group is even more preferably an acryloyl group or a methacryloyl group.

Examples of the PFPE having an acryloyl group or a methacryloyl group may include the Fluorolink AD1700, MD500, MD700, 5101X, and 5113X and the Fomblin MT70 ("FLUOROLINK" and "FOMBLIN" are both registered trademarks of the company) manufactured by Solvay Specialty Polymers, the OPTOOL DAC manufactured by DAIKIN INDUSTRIES, LTD., and the KY-1203 manufactured by Shin-Etsu Chemical Co., Ltd.

In addition, the radically polymerizable PFPE can be appropriately synthesized by using a PFPE having a hydroxyl group or a carboxyl group at the terminal as a starting material and substituting these substituents or deriving from these substituents, or such synthetic products may be used.

Examples of the PFPE having a hydroxyl group at the terminal may include the Fomblin D2, Fluorolink D4000, Fluorolink EtOH, 5158X, and 5147X, and Fomblin Z-tetraol manufactured by Solvay Specialty Polymers and the Demnum-SA manufactured by DAIKIN INDUSTRIES, LTD. Examples of the PFPE having a carboxyl group at the terminal may include the Fomblin ZDIZAC4000 manufactured by Solvay Specialty Polymers and the Demnum-SH manufactured by DAIKIN INDUSTRIES, LTD.

Specific examples of the PFPE having an acryloyl group or a methacryloyl group may include the following compounds P-1 to P-9. In the following formulas, X represents an acryloyl group (A) or a methacryloyl group (M). In addition, the term "p" in the compound P-2 independently represents from 1 to 10.

Incidentally, the following compounds may be more specifically indicated by adding A in a case in which X is an acryloyl group and M in a case in which X is a methacryloyl group to the symbol of the compounds. For example, the following compound P-1 in which X is an acryloyl group is denoted as "P-1A" and the following compound P-1 in which X is a methacryloyl group is denoted as "P-1M".

[Chem. 4]

P-1

$$XOCH_2—CF_2O(CF_2CF_2O)_m(CF_2O)_nCF_2—CH_2OX$$

P-2

$$XO(CH_2CH_2O)_pCH_2—CF_2O(CF_2CF_2O)_m(CF_2O)_nCF_2—CH_2(OCH_2CH_2)_pOX$$

P-3

$$(XOCH_2)_2CHO_2C—CF_2O(CF_2CF_2O)_m(CF_2O)_nCF_2—CO_2CH(CH_2OX)_2$$

P-4

$$(XOCH_2)_3CCH_2O_2C—CF_2O(CF_2CF_2O)_m(CF_2O)_nCF_2—CO_2CH_2C(CH_2OX)_3$$

P-5

$$XOCH_2\underset{\underset{XO}{|}}{CH}CH_2OCH_2—CF_2O(CF_2CF_2O)_m(CF_2O)_nCF_2—CH_2OCH_2\underset{\underset{OX}{|}}{CH}CH_2OX$$

P-6

$$XOCH_2CH_2NHCOOCH_2\underset{\underset{XOCH_2CH_2NHCOO}{|}}{CH}CH_2OCH_2—CF_2O(CF_2CF_2O)_m(CF_2O)_nCF_2—CH_2OCH_2\underset{\underset{OCONHCH_2CH_2OX}{|}}{CH}CH_2OCONHCH_2CH_2OX$$

P-7

$$(XOCH_2)_2(CH_3)CNHCOOCH_2—CF_2O(CF_2CF_2O)_m(CF_2O)_nCF_2—CH_2OCONHC(CH_3)(CH_2OX)_2$$

P-8

$$CF_3CF_2CF_2CF_2O(CF_2CF_2CF_2O)_nCF_2CF_2—CH_2OCONHC(CH_3)(CH_2OX)_2$$

P-9

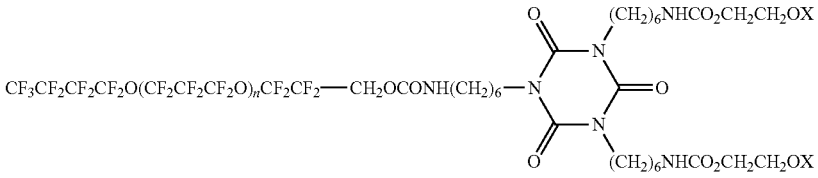

Hereinafter, a specific example of the method for synthesizing the radically polymerizable PFPE is presented.

Synthetic Example 1: Synthesis of P-2M

Mixed are 17 parts by mass of the Fluorolink E10H (manufactured by Solvay Specialty Polymers, average molecular weight: 1700) that is a perfluoropolyether compound having a hydroxyl group at both terminals and is represented by the following formula P-S1, 3 parts by mass of triethylamine, 10 parts by mass of diisopropyl ether, and 0.006 part by mass of p-methoxyphenol of a polymerization inhibitor, stirring of the mixture is started in an air stream. While keeping the temperature of the mixture at 10° C., 3.1 parts by mass of methacryloyl chloride is added thereto dropwise over 2 hours. After the dropwise addition is completed, the mixture thus obtained is stirred for 1 hour while keeping it at 10° C., subsequently the reaction mixture is heated to 30° C., stirred for 1 hour at 30° C., further heated to 50° C., and stirred for 10 hours at 50° C. to conduct the reaction. Subsequently, 72 parts by mass of diisopropyl ether is added to the reaction mixture thus obtained, and the diisopropyl ether phase is washed with water three times. Subsequently, the diisopropyl ether phase is dried over magnesium sulfate, and the solvent is distilled off therefrom. P-2M of a radically polymerizable PFPE is obtained in this manner (yield: 17.1 parts by mass).

[Chem. 5]

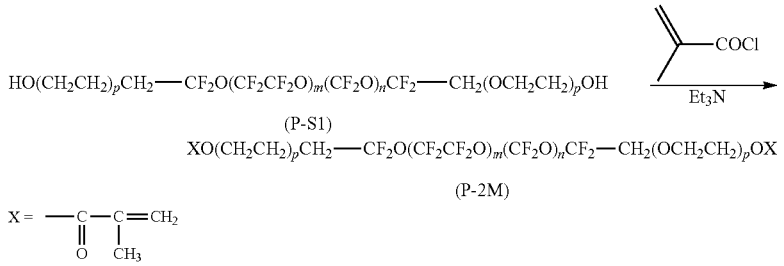

Synthetic Example 2: Synthesis of P-3M (1) Synthesis of Intermediate (I)

Mixed are 18.5 parts by mass of the Fomblin ZDIAC4000 (manufactured by Solvay Specialty Polymers, average molecular weight: 3700) that is a perfluoropolyether compound having a carboxyl group at both terminals and represented by the following formula P-S2, 20 parts by mass of thionyl chloride, and 2 drops of N,N-dimethylformamide, the mixture is heated and refluxed for 4 hours. Excess thionyl chloride is distilled off from the reaction mixture thus obtained, thereby obtaining 18.6 parts by mass of an intermediate (I).

(2) Synthesis of P-3M

In 50 parts by mass of dichloroethane, 2.3 parts by mass of glycerol dimethacrylate, 0.8 part by mass of pyridine, and 0.006 part by mass of p-methoxyphenol of a polymerization inhibitor are dissolved, 18.6 parts by mass of the intermediate (I) is added to the solution thus obtained. The mixture thus obtained is stirred for the night at room temperature as it is, subsequently water is added thereto to separate the dichloroethane phase. Thereafter, the dichloroethane phase is washed with water, and the solvent is distilled off therefrom. P-3M of a radically polymerizable PFPE is obtained in this manner (yield: 20.2 parts by mass).

[Chem. 6]

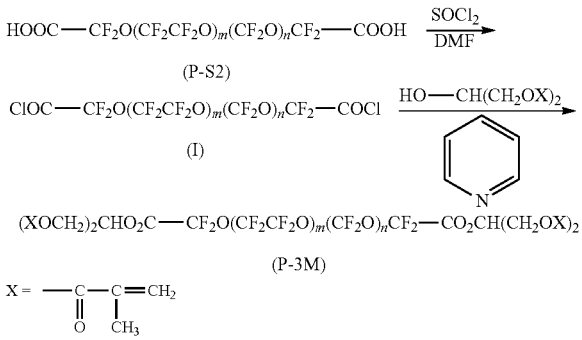

Synthetic Example 3: Synthesis of P-6A

Mixed are 20 parts by mass of the Fomblin Z-tetraol (manufactured by Solvay Specialty Polymers) that is a perfluoropolyether compound having a hydroxyl group at both terminals and represented by the following formula P-S3, 0.01 part by mass of p-methoxyphenol of a polymerization inhibitor, 0.01 part by mass of dibutyltin dilaurate of a urethanated catalyst, and 20 parts by mass of methyl ethyl ketone, the mixture is stirred in an air stream and heated to 80° C. Subsequently, 5.7 parts by mass of 2-(acryloyloxy) ethyl isocyanate is added to the mixture in a divided manner while paying attention to heat generation. Subsequently, the mixture is stirred for 10 hours at 80° to conduct the reaction. The solvent is distilled off from the mixture after the disappearance of the absorption peak in the vicinity of 2360 $cm^{-1}$ attributed to the isocyanate group is confirmed through the IR spectrum measurement. P-6A of a radically polymerizable PFPE is obtained in this manner (yield: 25.6 parts by mass).

The other exemplified compounds among P-1 to P-9 above can be synthesized in the same manner by any of the following methods.

1) A method to subject (meth)acryloyl chloride to an esterification reaction with a perfluoropolyether having a hydroxyl group at the terminal by dehydrochlorination.

2) A method to subject an isocyanate compound having a (meth)acryloyl group to an urethanization reaction with a perfluoropolyether having a hydroxyl group at the terminal.

3) A method to obtain an acid halide of a perfluoropolyether compound having a carboxyl group at the terminal by an ordinary method and to subject a compound having a (meth)acryloyl group and a hydroxyl group to an esterification reaction with the acid halide.

With regard to the content of the radically polymerizable PFPE in the radically polymerizable composition, the cleaning property of the photoreceptor is insufficient when it is too low and the wear resistance and scratch resistance of the photoreceptor are insufficient in some cases when it is too high. The content of the radically polymerizable PFPE in the radically polymerizable composition is preferably 10 parts by mass or more and more preferably 20 parts by mass or more with respect to 100 parts by mass of the radically polymerizable monomer from the viewpoint of sufficiently exerting the cleaning property. In addition, the content is preferably 100 parts by mass or less and more preferably 70 parts by mass or less from the viewpoint of sufficiently exerting the wear resistance and the scratch resistance.

[Metal Oxide Fine Particles Having Radically Polymerizable Group]

The metal oxide fine particles having a radically polymerizable group (hereinafter, also referred to as the "radically polymerizable metal oxide fine particles") are metal oxide fine particles supporting a component containing a radically polymerizable group on the surface. Supporting of a component containing a radically polymerizable group on the surface of the metal oxide fine particles may be physical supporting or supporting by a chemical bond. The radically polymerizable group may be one kind or more kinds and a plurality of radically polymerizable groups may be the same as or different from one another. The radically polymerizable metal oxide fine particles have, for example, metal oxide fine particles, a surface treatment agent residue that is chemically bonded to the surface thereof, and the radically polymerizable group contained in the surface treatment agent residue, and in the protective layer, the metal oxide fine particles are present in a state of being chemically bonded to the integral polymer constituting the protective layer via the surface treatment agent residue on the surface thereof. Incidentally, the surface treatment agent residue is,

[Chem. 7]

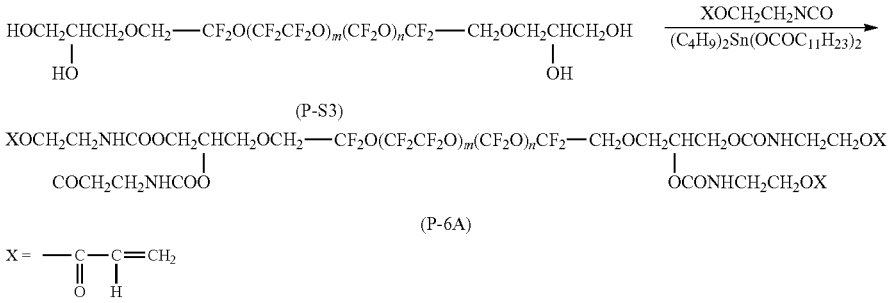

for example, a molecular structure that is chemically bonded to the surface of the metal oxide fine particles and a moiety derived from the surface treatment agent.

The metal in the metal oxide fine particles includes a transition metal as well. The metal oxide fine particles may also be one kind or more kinds, and they may be the same kind as or different kinds from one another. Examples of the metal oxide in the metal oxide fine particles may include silica (silicon oxide), magnesium oxide, zinc oxide, lead oxide, alumina (aluminum oxide), tin oxide, tantalum oxide, indium oxide, bismuth oxide, yttrium oxide, cobalt oxide, copper oxide, manganese oxide, selenium oxide, iron oxide, zirconium oxide, germanium oxide, titanium dioxide, niobium oxide, molybdenum oxide, vanadium oxide, and copper aluminum oxide. Among them, the metal oxide is preferably alumina ($Al_2O_3$), tin oxide ($SnO_2$), titanium dioxide ($TiO_2$), and copper aluminum composite oxide ($CuAlO_2$).

The number average primary particle size of the metal oxide fine particles is preferably in a range of from 1 to 300 nm. It is even more preferably from 3 to 100 nm. The number average primary particle size of the metal oxide fine particles may be the catalog value or can be determined as follows. In other words, a photograph that is enlarged by 10000-fold and taken by a scanning electron microscope (manufactured by JEOL Ltd.) is scanned by a scanner, the images of 300 particles taken from the photographic image thus obtained except the aggregated particles are randomly subjected to the binarization processing using the automatic image processing and analysis system "Luzex AP" (developed by Nireco Corporation, "LUZEX" is a registered trademark of the company, software Ver. 1.32), the Feret's diameters in the horizontal direction of the respective particle images are calculated, and the average value thereof is calculated and adopted as the number average primary particle size. Here, the Feret's diameter in the horizontal direction refers to the length of a side parallel to the x axis of the bounding rectangle when the particle image is subjected to the binarization processing.

Supporting of the component containing a radically polymerizable group on the surface of the metal oxide fine particles can be conducted by a known surface treatment technique for metal oxide fine particles. For example, the supporting can be conducted by a known surface treatment method using a surface treatment agent for metal oxide fine particles as described in JP 2012-078620 A.

The surface treating agent has a radically polymerizable group and a surface treating group. The surface treatment agent may be one kind or more kinds. The surface treating group is a functional group exhibiting reactivity to a polar group such as a hydroxyl group present on the surface of the metal oxide fine particles. The radically polymerizable group is a group which has a carbon-carbon double bond and is radically polymerizable as that of the radically polymerizable monomer or radically polymerizable PFPE, and examples thereof may include a vinyl group, an acrylic group, and a methacrylic group.

The surface treatment agent is preferably a silane coupling agent having the radically polymerizable group, and examples thereof may include the following compounds S-1 to S-36.

$CH_2{=}CHSi(CH_3)(OCH_3)_2$ S-1:

$CH_2{=}CHSi(OCH_3)_3$ S-2:

$CH_2{=}CHSiCl_3$ S-3:

$CH_2{=}CHCOO(CH_2)_2Si(CH_3)(OCH_3)_2$ S-4:

$CH_2{=}CHCOO(CH_2)_2Si(OCH_3)_3$ S-5:

$CH_2{=}CHCOO(CH_2)_2Si(OC_2H_5)(OCH_3)_2$ S-6:

$CH_2{=}CHCOO(CH_2)_3Si(OCH_3)_3$ S-7:

$CH_2{=}CHCOO(CH_2)_2Si(CH_3)Cl_2$ S-8:

$CH_2{=}CHCOO(CH_2)_2SiCl_3$ S-9:

$CH_2{=}CHCOO(CH_2)_3Si(CH_3)Cl_2$ S-10:

$CH_2{=}CHCOO(CH_2)_3SiCl_3$ S-11:

$CH_2{=}C(CH_3)COO(CH_2)_2Si(CH_3)(OCH_3)_2$ S-12:

$CH_2{=}C(CH_3)COO(CH_2)_2Si(OCH_3)_3$ S-13:

$CH_2{=}C(CH_3)COO(CH_2)_3Si(CH_3)(OCH_3)_2$ S-14:

$CH_2{=}C(CH_3)COO(CH_2)_3Si(OCH_3)_3$ S-15:

$CH_2{=}C(CH_3)COO(CH_2)_2Si(CH_3)Cl_2$ S-16:

$CH_2{=}C(CH_3)COO(CH_2)_2SiCl_3$ S-17:

$CH_2{=}C(CH_3)COO(CH_2)_3Si(CH_3)Cl_2$ S-18:

$CH_2{=}C(CH_3)COO(CH_2)_3SiCl_3$ S-19:

$CH_2{=}CHSi(C_2H_5)(OCH_3)_2$ S-20:

$CH_2{=}C(CH_3)Si(OCH_3)_3$ S-21:

$CH_2{=}C(CH_3)Si(OC_2H_5)_3$ S-22:

$CH_2{=}CHSi(OCH_3)_3$ S-23:

$CH_2{=}C(CH_3)Si(CH_3)(OCH_3)_2$ S-24:

$CH_2{=}CHSi(CH_3)Cl_2$ S-25:

$CH_2{=}CHCOOSi(OCH_3)_3$ S-26:

$CH_2{=}CHCOOSi(OC_2H_5)_3$ S-27:

$CH_2{=}C(CH_3)COOSi(OCH_3)_3$ S-28:

$CH_2{=}C(CH_3)COOSi(OC_2H_5)_3$ S-29:

$CH_2{=}C(CH_3)COO(CH_2)_3Si(OC_2H_5)_3$ S-30:

$CH_2{=}CHCOO(CH_2)_2Si(CH_3)_2(OCH_3)$ S-31:

$CH_2{=}CHCOO(CH_2)_2Si(CH_3)(OCOCH_3)_2$ S-32:

$CH_2{=}CHCOO(CH_2)_2Si(CH_3)(ONHCH_3)_2$ S-33:

$CH_2{=}CHCOO(CH_2)_2Si(CH_3)(OC_6H_5)_2$ S-34:

$CH_2{=}CHCOO(CH_2)_2Si(C_{10}H_{21})(OCH_3)_2$ S-35:

$CH_2{=}CHCOO(CH_2)_2Si(CH_2C_6H_5)(OCH_3)_2$ S-36:

With regard to the content of the radically polymerizable metal oxide fine particles in the radically polymerizable composition, the wear resistance and scratch resistance of the photoreceptor are insufficient in some cases when the content is too low. In addition, the content of PFPE in the protective layer is relatively low when the content is too high, and as a result, the cleaning property of the photoreceptor is insufficient in some cases. The content of the radically polymerizable metal oxide fine particles in the radically polymerizable composition is preferably 30 parts by mass or more with respect to 100 parts by mass of the sum of the radically polymerizable monomer and the radically polymerizable PFPE from the viewpoint of sufficiently exerting the mechanical strength of the protective layer and also realizing a proper electric resistance. In addition, the content of the radically polymerizable metal oxide fine particles in the radically polymerizable composition is preferably 100 parts by mass or less from the viewpoint of sufficiently exerting the cleaning property.

The photoreceptor can be manufactured by a known method for manufacturing a photoreceptor except that the radically polymerizable composition is used in the coating material for protective layer. For example, the photoreceptor can be manufactured by a method including a step of applying a coating material for protective layer containing the radically polymerizable composition on the surface of a photosensitive layer formed on a conductive support and a step of radically polymerizing the radically polymerizable group in the coating material for protective layer by irradiating the applied coating material for protective layer with an active ray or heating the applied coating material for protective layer.

The coating material for protective layer may further contain other components other than the radically polymerizable composition in a range in which the effect of the present embodiment is obtained. Examples of such other components may include a solvent and a polymerization initiator.

The solvents may be one kind or more kinds. Examples of such a solvent may include methanol, ethanol, n-propyl alcohol, isopropyl alcohol, n-butanol, t-butanol, sec-butanol, benzyl alcohol, toluene, xylene, methyl ethyl ketone, cyclohexane, ethyl acetate, butyl acetate, methyl cellosolve, ethyl cellosolve, tetrahydrofuran, 1,3-dioxane, 1,3-dioxolane, pyridine, and diethylamine.

The polymerization initiator may be one kind or more kinds. The polymerization initiator can be appropriately selected from known polymerization initiators depending on the manufacturing process of the protective layer. Examples of the polymerization initiator may include a photopolymerization initiator, a thermal polymerization initiator, and a polymerization initiator capable of initiating polymerization by both of light and heat.

Examples of the polymerization initiator may include an azo compound such as 2,2'-azobisisobutyronitrile, 2,2'-azobis(2,4-dimethylazobisvaleronitrile), or 2,2'-azobis(2-methylbutyronitrile) and a peroxide such as benzoyl peroxide (BPO), di-tert-butyl hydroperoxide, tert-butyl hydroperoxide, chlorobenzoyl peroxide, dichlorobenzoyl peroxide, bromomethylbenzoyl peroxide, or lauroyl peroxide.

In addition, examples of the polymerization initiator may include an acetophenone-based or ketal-based photopolymerization initiator, and examples thereof may include diethoxyacetophenone, 2,2-dimethoxy-1,2-diphenylethane-1-one, 1-hydroxycyclohexyl phenyl ketone, 4-(2-hydroxyethoxy)phenyl-(2-hydroxy-2-propyl) ketone (12), 2-benzyl-2-dimethylamino-1-(4-morpholinophenyl)butanone-1 (Irgacure 369: manufactured by BASF Japan, "IRGACURE" is a registered trademark of BASF), 2-hydroxy-2-methyl-1-phenylpropan-1-one, 2-methyl-2-morpholino(4-methylthiophenyl)propan-1-one, and 1-phenyl-1,2-propanedione-2-(o-ethoxycarbonyl)oxime.

In addition, examples of the polymerization initiator may include a benzoin ether-based photopolymerization initiator such as benzoin, benzoin methyl ether, benzoin ethyl ether, benzoin isobutyl ether, or benzoin isopropyl ether, and a benzophenone-based photopolymerization initiator such as benzophenone, 4-hydroxybenzophenone, methyl o-benzoylbenzoate, 2-benzoylnaphthalene, 4-benzoylbiphenyl, 4-benzoyl phenyl ether, acrylated benzophenone, or 1,4-benzoylbenzene.

In addition, examples of the polymerization initiator may include a thioxanthone-based photopolymerization initiator such as 2-isopropylthioxanthone, 2-chlorothioxanthone, 2,4-dimethylthioxanthone, 2,4-diethylthioxanthone, or 2,4-dichlorothioxanthone.

In addition, examples of the polymerization initiator may include ethyl anthraquinone, 2,4,6-trimethylbenzoyldiphenylphosphine oxide, 2,4,6-trimethylbenzoylphenylethoxyphosphine oxide, bis(2,4,6-trimethylbenzoyl)phenylphosphine oxide, bis(2,4-dimethoxybenzoyl)-2,4,4-trimethylpentylphosphine oxide, methylphenyl glyoxylate, 9,10-phenanthrene, an acridine compound, a triazine compound, and an imidazole compound.

In addition, the photopolymerization initiator may be concurrently used with a photopolymerization promoter having a photopolymerization promoting effect. Examples of the photopolymerization promoter may include triethanolamine, methyldiethanolamine, ethyl 4-dimethylaminobenzoate, isoamyl 4-dimethylaminobenzoate, (2-dimethylamino)ethyl benzoate, and 4,4-dimethylaminobenzophenone.

The polymerization initiator is preferably a photopolymerization initiator, and for example, an alkylphenone-based compound and a phosphine oxide-based compound are preferable, a polymerization initiator having an $\alpha$-hydroxyacetophenone structure or a polymerization initiator having an acylphosphine oxide structure is more preferable.

The content of the polymerization initiator in the radically polymerizable composition is preferably from 0.1 to 40 parts by mass and more preferably from 0.5 to 20 parts by mass with respect to 100 parts by mass of the radically polymerizable monomer.

In the protective layer, the radically polymerizable monomer, the radically polymerizable PFPE, and the radically polymerizable metal oxide fine particles constitute an integral polymer (polymerized and cured product) which forms the protective layer. It is possible to confirm that the polymerized and cured product is a polymer of the radically polymerizable monomer, the radically polymerizable PFPE, and the radically polymerizable metal oxide fine particles by analyzing the polymerized and cured product by a by known instrumental analysis technique such as pyrolysis GC-MS, nuclear magnetic resonance (NMR), Fourier transform infrared spectroscopy (FT-IR), or elemental analysis.

The radically polymerizable monomer, the radically polymerizable PFPE, and the radically polymerizable metal oxide fine particles all have a radically polymerizable group. Hence, these components exhibit high compatibility with one another in the radically polymerizable composition. Consequently, the radically polymerizable PFPE and the radically polymerizable metal oxide fine particles are both uniformly dispersed in the radically polymerizable composition. As a result, the PFPE and the metal oxide fine particles are present in the protective layer to be uniformly dispersed in both the plane direction and the thickness direction thereof as well.

In the protective layer, the respective radically polymerizable groups of the radically polymerizable monomer, the radically polymerizable PFPE, and the radically polymerizable metal oxide fine particles react with one another to form a crosslinked structure. Hence, a highly strong protective layer exhibiting sufficient wear resistance is obtained even when the content of PFPE is high to some extent.

Furthermore, high cleaning property of the protective layer is maintained over a long period of time. This is believed to be due to the following reasons. In other words, the PFPE is present in the protective layer in a state of being bonded with the metal oxide fine particles as well. Hence, the PFPE is likely to exist by being dispersed throughout the protective layer. In this manner, the PFPE and the metal oxide fine particles are present in the protective layer by being dispersed in both directions of the plane direction and the thickness direction of the protective layer, and thus the PFPE is present on the surface of the protective layer in an amount enough to maintain the cleaning property even when the protective layer is worn away.

Furthermore, the bonding sites of the radically polymerizable monomer and the radically polymerizable metal oxide particles with the PFPE increase when the radically polymerizable PFPE has 4 or more radically polymerizable groups. Hence, a protective layer of which even higher wear resistance and higher cleaning property last is obtained.

The photoreceptor is used as an organic photoreceptor in an electrophotographic image forming apparatus. For example, the image forming apparatus includes the photoreceptor, a charging device for charging the surface of the photoreceptor, an exposure device for forming an electrostatic latent image by irradiating the charged surface of the photoreceptor with light, a developing device for forming a toner image by supplying toner to the photoreceptor on which an electrostatic latent image is formed, a transfer device for transferring the toner image on the surface of the photoreceptor to a recording medium, and a cleaning device for removing the toner remaining on the surface of the photoreceptor from which the toner image has been transferred to the recording medium.

In addition, the photoreceptor is applied to an image forming method in which a toner image corresponding to an electrostatic latent image is formed on the surface of the photoreceptor by supplying the toner to the surface of the photoreceptor on which the electrostatic latent image is formed, the toner image is transferred from the surface of the photoreceptor to a recording medium, and the toner remaining on the surface of the photoreceptor is removed by using a cleaning device. The image forming method is performed, for example, by using the image forming apparatus described above.

FIG. 1 is a diagram schematically showing an example of the configuration of an image forming apparatus having the photoreceptor. An image forming apparatus 100 shown in FIG. 1 includes an image reading section 110, an image processing section 30, an image forming section 40, a sheet conveying section 50, and a fixing device 60.

The image forming section 40 includes image forming units 41Y, 41M, 41C, and 41K which form an image with the respective color toners Y (yellow), M (magenta), C (cyan), and K (black). These all have the same configuration except the toner to be accommodated, and hereinafter, the symbol representing the color is omitted in some cases. The image forming section 40 further includes an intermediate transfer unit 42 and a secondary transfer unit 43. These correspond to a transfer device.

The image forming unit 41 includes an exposure device 411, a developing device 412, the photoreceptor described above 413, a charging device 414, and a drum cleaning device 415. The charging device 414 is, for example, a corona charger. The charging device 414 may be a contact charging device which charges the photoreceptor 413 by bringing a contact charging member such as a charging roller, a charging brush, or a charging blade into contact with the photoreceptor 413. The exposure device 411 includes, for example, a semiconductor laser as a light source and a light deflecting device (polygon motor) to irradiate the photoreceptor 413 with the laser beam corresponding to an image to be formed.

The developing device 412 is a developing device of a two-component developing system. The developing device 412 includes, for example, a developer container for accommodating a two-component developer, a developing roller (magnetic roller) that is rotatably disposed to the opening of the developer container, a partition wall which partitions the inside of the developer container so that the two-component developer is communicable, a conveying roller for conveying the two-component developer on the opening side of the developer container toward the developing roller, and a stirring roller for stirring the two-component developer in the developer container. In the developer container describe above, for example, a two-component developer to be described later is accommodated.

The intermediate transfer unit 42 includes an intermediate transfer belt 421, a primary transfer roller 422 to press the intermediate transfer belt 421 against the photoreceptor 413 so as to be in contact with each other, a plurality of support rollers 423 which includes a backup roller 423A, and a belt cleaning device 426. The intermediate transfer belt 421 is stretched to the plurality of support rollers 423 in a loop shape. The intermediate transfer belt 421 runs in the arrow A direction at a constant velocity as at least one driving roller of the plurality of support rollers 423 rotates.

The secondary transfer unit 43 includes an endless secondary transfer belt 432 and a plurality of support rollers 431 which include a secondary transfer roller 431A. The secondary transfer belt 432 is stretched in a loop shape by the secondary transfer roller 431A and the support rollers 431.

The fixing device 60 includes, for example, a fixing roller 62, an endless heating belt 10 which covers the outer circumferential surface of the fixing roller 62 and heats and melts the toner constituting the toner image on the sheet S, and a pressure roller 63 to press the sheet S toward the fixing roller 62 and the heating belt 10. The sheet S corresponds to the recording medium.

The image forming apparatus 100 further includes an image reading section 110, an image processing section 30, and a sheet conveying section 50. The image reading section 110 includes a sheet feeding device 111 and a scanner 112. The sheet conveying section 50 includes a paper feeding unit 51, a paper discharge portion 52, and a conveying path 53. In three paper feeding tray units 51*a* to 51*c* constituting the paper feeding unit 51, the sheet S (standard paper, special paper) identified based on the basis weight and the size is accommodated for each kind set in advance. The conveying path 53 includes a plurality of conveying roller pairs such as a resist roller pair 53*a*.

The formation of an image by the image forming apparatus 100 is described.

A scanner 112 reads a document D on the contact glass by optically scanning it. The reflected light from the document D is read by a CCD sensor 112*a* to be input image data. The input image data is subjected to the predetermined image processing in an image processing section 30 and sent to the exposure device 411.

The photoreceptor 413 rotates at a constant circumferential velocity. The charging device 414 uniformly charges the surface of the photoreceptor 413 to the negative polarity. In the exposure device 411, the polygon mirror of the polygon motor rotates at a high velocity, a laser beam corresponding to the input image data for each color component spreads along the axial direction of the photoreceptor 413, and the outer circumferential surface of the photoreceptor 413 is irradiated with the laser beam along the axial direction. In this manner, an electrostatic latent image is formed on the surface of the photoreceptor 413.

In the developing device 412, the toner particles are charged as the two-component developer in the developer container is stirred and conveyed, the two-component developer is conveyed to the developing roller, a magnetic brush is formed on the surface of the developing roller. The charged toner particles are electrostatically attached from the magnetic brush to the portion of the electrostatic latent image on the photoreceptor 413. In this manner, the electrostatic latent image on the surface of the photoreceptor 413 is visualized and a toner image corresponding to the electrostatic latent image is formed on the surface of the photoreceptor 413. Incidentally, the term "toner image" refers to a state in which the toner is gathered in an image shape.

The toner image on the surface of the photoreceptor 413 is transferred to the intermediate transfer belt 421 by the intermediate transfer unit 42. The toner remaining on the surface of the photoreceptor 413 after the transfer is removed by the drum cleaning device 415 which has a drum cleaning blade and is brought into sliding contact with the surface of the photoreceptor 413.

In the protective layer of the photoreceptor 413, the PFPE and the metal oxide fine particles are uniformly dispersed throughout the protective layer that is integrally constituted by a polymer obtained by radical polymerization of a radically polymerizable monomer in sufficient amounts as described above. Hence, the wear resistance and scratch resistance by the polymer and the metal oxide fine particles and high cleaning property by the PFPE are sufficiently exerted. Consequently, the photoreceptor 413 exhibits excellent wear resistance, scratch resistance, and cleaning property and exerts these properties over a long period of time.

As the intermediate transfer belt 421 is pressed against the photoreceptor 413 so as to be in contact with each other by the primary transfer roller 422, a primary transfer nip is formed for each photoreceptor by the photoreceptor 413 and the intermediate transfer belt 421. In the primary transfer nip, the toner images of the respective colors are sequentially transferred and superimposed on the intermediate transfer belt 421.

Meanwhile, the secondary transfer roller 431A is pressed against the backup roller 423A so as to be in contact with each other via the intermediate transfer belt 421 and the secondary transfer belt 432. In this manner, a secondary transfer nip is formed by the intermediate transfer belt 421 and the secondary transfer belt 432. The sheet S passes through the secondary transfer nip. The sheet S is conveyed to the secondary transfer nip by the sheet conveying section 50. The correction of the inclination of the sheet S and the adjustment of the transport timing are carried out by a resist roller portion on which the resist roller pair 53*a* is disposed.

The transfer bias is applied to the secondary transfer roller 431A when the sheet S is conveyed to the secondary transfer nip. The toner image supported on the intermediate transfer belt 421 is transferred onto the sheet S by this application of transfer bias. The sheet S on which the toner image is transferred is conveyed toward the fixing device 60 by the secondary transfer belt 432.

In the fixing device 60, a fixing nip is formed by the heating belt 10 and the pressure roller 63 and the sheet S conveyed is heated and pressurized at the fixing nip portion. In this manner, the toner image is fixed on the sheet S. The sheet S on which the toner image is fixed is discharged outside the apparatus by a paper discharge portion 52 having a paper discharge roller 52*a*.

Incidentally, the toner remaining on the surface of the intermediate transfer belt 421 after the secondary transfer is removed by the belt cleaning device 426 which has a belt cleaning blade and is brought into sliding contact with the surface of the intermediate transfer belt 421.

The photoreceptor 413 exhibits excellent wear resistance, scratch resistance, and cleaning property and exerts these properties over a long period of time as described above. Hence, the image forming apparatus 100 can stably form an image having the desired image quality over a long period of time.

As apparent from the above description, the photoreceptor according to the present embodiment includes a conductive support, a photosensitive layer disposed on the conductive support, and a protective layer disposed on the photosensitive layer. Moreover, the protective layer is formed of a polymerized and cured product of a radically polymerizable composition containing the radically polymerizable monomer, the radically polymerizable PFPE, and the radically polymerizable metal oxide fine particles. Hence, the photoreceptor exhibits excellent wear resistance, scratch resistance, and cleaning property and can exert these properties over a long period of time. As a result, the photoreceptor exhibits high wear resistance and scratch resistance and excellent toner releasing property, and the formation of abnormal images due to cleaning failure and the like can be suppressed over a long period of time.

In addition, it is even more effective that the radically polymerizable PFPE is a PFPE having 4 or more radically polymerizable groups from the viewpoint of achieving the wear resistance and the scratch resistance together with the cleaning property.

In addition, it is more effective that the content of the perfluoropolyether compound in the polymerized and cured product is from 10 to 100 parts by mass in terms of the content of the radically polymerizable PFPE with respect to 100 parts by mass of the radically polymerizable monomer in the radically polymerizable composition from the viewpoint of sufficiently exerting the wear resistance and the scratch resistance together with the cleaning property.

In addition, it is more effective that the content of the metal oxide fine particles in the polymerized and cured product is from 30 to 100 parts by mass in terms of the content of the radically polymerizable metal oxide fine particles with respect to 100 parts by mass of the sum of the radically polymerizable monomer and the radically polymerizable PFPE in the radically polymerizable composition from the viewpoint of sufficiently exerting the wear resistance and the scratch resistance together with the cleaning property.

EXAMPLES

[Production of Metal Oxide Fine Particles 1]

In a wet sand mill (media: alumina beads having a size of 0.5 mm), 100 parts by mass of "tin oxide" having a number average primary particle size of 20 nm as metal oxide fine particles, 10 parts by mass of the "exemplified compound S-15" as a surface treatment agent, and 1000 parts by mass of methyl ethyl ketone were put and mixed for 6 hours at 30° C. Thereafter, methyl ethyl ketone and alumina beads were separated from the metal oxide fine particles through filtration, and the metal oxide fine particles were dried at 60° C.

In this manner, metal oxide fine particles 1 of the radically polymerizable metal oxide fine particles described above were produced.

[Production of Metal Oxide Fine Particles 2]

Metal oxide fine particles 2 of the radically polymerizable metal oxide fine particles described above were produced in the same manner as the production of metal oxide fine particles 1 except that the metal oxide fine particles were changed to "copper aluminum oxide" having a number average primary particle size of 50 nm and the amount of the surface treatment agent used was changed to 5 parts by mass.

[Production of Metal Oxide Fine Particles 3]

Metal oxide fine particles 3 of the radically polymerizable metal oxide fine particles described above were produced in the same manner as the production of metal oxide fine particles 2 except that the "exemplified compound S-7" was used as a surface treatment agent.

[Production of Metal Oxide Fine Particles 4]

Metal oxide fine particles 4 were produced in the same manner as the production of metal oxide fine particles 1 except that trimethoxypropylsilane was used as a surface treatment agent.

Example 1: Production of Photoreceptor 1

(1) Preparation of Conductive Support

A conductive support was prepared by subjecting the surface of a cylindrical aluminum support to cutting.

(2) Formation of Intermediate Layer

Polyamide resin (X1010 manufactured by Daicel-Evonik Ltd.) 10 parts by mass

Titanium oxide particles (SMT500SAS manufactured by Tayca Corporation) 11 parts by mass Ethanol 200 parts by mass The above materials for an intermediate layer were mixed together and dispersed batchwise for 10 hours by using a sand mill as a disperser, thereby preparing a coating liquid for intermediate layer. The coating liquid was applied on the surface of the conductive support by a dip coating method, and dried for 20 minutes at 110° C., thereby forming an intermediate layer having a thickness of 2 μm on a conductive support.

(3) Formation of Charge Generating Layer

Charge generating material (mixed crystal of a 1:1 adduct of titanyl phthalocyanine having clear peaks at 8.3°, 24.7°, 25.1°, and 26.5° in the Cu-Kα characteristic X-ray diffraction spectrum measurement and (2R,3R)-2,3-butanediol and titanyl phthalocyanine that is not added) 24 parts by mass Polyvinyl butyral resin (S-LEC BL-1 manufactured by SEKISUI CHEMICAL CO., LTD., "S-LEC" is a registered trademark of the company) 12 parts by mass Mixture (3-methyl-2-butanone/cyclohexanone=4/1 (V/V) 400 parts by mass The above materials for a charge generating layer were mixed and dispersed for 0.5 hour at 19.5 kHz, 600 W, and a circulating flow rate of 40 L/H by using the circulating ultrasonic homogenizer "RUS-600TCVP" (manufactured by NiSSEI Corporation), thereby preparing a coating liquid for charge generating layer. The coating liquid was applied on the surface of the intermediate layer by a dip coating method and dried, thereby forming a charge generating layer having a thickness of 0.3 μm on the intermediate layer.

(4) Formation of Charge Transport Layer

Charge transport material represented by the following structural formula (2) 60 parts by mass Polycarbonate resin (Z300 manufactured by MITSUBISHI GAS CHEMICAL COMPANY, INC.) 100 parts by mass Antioxidant (IRGANOX 1010 manufactured by BASF, "IRGANOX" is a registered trademark of the company) 4 parts by mass The above materials for a charge transport layer were mixed and dissolved, thereby preparing a coating liquid for charge transport layer. The coating liquid was applied on the surface of the charge generating layer by a dip coating method and dried for 70 minutes at 120° C., thereby forming a charge transport layer having a thickness of 24 μm on the charge transport layer.

[Chem. 8]

(2)

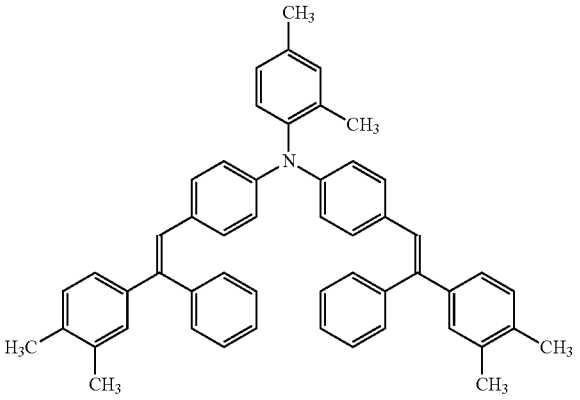

(5) Formation of Protective Layer

Radically polymerizable monomer (M1) 120 parts by mass

Radically polymerizable PFPE (P-2M) 30 parts by mass

Metal oxide fine particles 1 100 parts by mass

Polymerization initiator (Irgacure 819 manufactured by BASF Japan) 10 parts by mass 2-butanol 400 parts by mass The above materials for a protective layer were dissolved and dispersed, thereby preparing a coating liquid for protective layer. The coating liquid was applied on the surface of the charge transport layer by using a circular slide hopper coater. Subsequently, the film of the applied coating liquid was irradiated with ultraviolet light for 1 minute by using a metal halide lamp to cure the film, thereby forming a protective layer having a thickness of 3.0 μm on the charge transport layer. In this manner, a photoreceptor 1 was produced.

Examples 2 and 3: Production of Photoreceptors 2 and 3

A photoreceptor 2 was produced in the same manner as in the production of the photoreceptor 1 except that the radically polymerizable monomer was changed to M2 and the radically polymerizable PFPE was changed to P-2A. In addition, a photoreceptor 3 was produced in the same manner as in the production of the photoreceptor 2 except that the radically polymerizable PFPE was changed to P-3M.

Example 4: Production of Photoreceptor 4

A photoreceptor 4 was produced in the same manner as in the production of the photoreceptor 1 except that the radically polymerizable monomer was changed to M11 and the added amount thereof was changed to 100 parts by mass and the radically polymerizable PFPE was changed to P-4A and the added amount thereof was changed to 50 parts by mass.

Examples 5 and 6: Production of Photoreceptors 5 and 6

A photoreceptor 5 was produced in the same manner as in the production of the photoreceptor 1 except that the radically polymerizable PFPE was changed to P-5A. In addition, a photoreceptor 6 was produced in the same manner as in the production of the photoreceptor 1 except that the radically polymerizable PFPE was changed to P-6A.

Examples 7 to 13: Production of Photoreceptors 7 to 13

A photoreceptor 9 was produced in the same manner as in the production of the photoreceptor 1 except that the amount of the radically polymerizable monomer added was changed to 125 parts by mass and the radically polymerizable PFPE was changed to P-6M and the added amount thereof was changed to 25 parts by mass.

In addition, a photoreceptor 7 was produced in the same manner as in the production of the photoreceptor 9 except that the amount of the radically polymerizable monomer added was changed to 140 parts by mass and the amount of the radically polymerizable PFPE added was changed to 10 parts by mass. Furthermore, a photoreceptor 8 was produced in the same manner as in the production of the photoreceptor 9 except that the amount of the radically polymerizable monomer added was changed to 136 parts by mass and the amount of the radically polymerizable PFPE added was changed to 14 parts by mass.

In addition, a photoreceptor 10 was produced in the same manner as in the production of the photoreceptor 9 except that the amount of the radically polymerizable monomer added was changed to 100 parts by mass and the amount of the radically polymerizable PFPE added was changed to 50 parts by mass. Furthermore, a photoreceptor 11 was produced in the same manner as in the production of the photoreceptor 9 except that the amount of the radically polymerizable monomer added was changed to 90 parts by mass and the amount of the radically polymerizable PFPE added was changed to 60 parts by mass.

In addition, a photoreceptor 12 was produced in the same manner as in the production of the photoreceptor 9 except that the amount of the radically polymerizable monomer added was changed to 75 parts by mass and the amount of the radically polymerizable PFPE added was changed to 75 parts by mass. Furthermore, a photoreceptor 13 was produced in the same manner as in the production of the photoreceptor 9 except that the amount of the radically polymerizable monomer added was changed to 70 parts by mass and the amount of the radically polymerizable PFPE added was changed to 80 parts by mass.

Examples 14 and 15: Production of Photoreceptors 14 and 15

A photoreceptor 14 was produced in the same manner as in the production of the photoreceptor 10 except that the amount of the metal oxide fine particles 1 added was changed to 45 parts by mass. In addition, a photoreceptor 15 was produced in the same manner as in the production of the photoreceptor 10 except that the amount of the metal oxide fine particles added was changed to 150 parts by mass.

Examples 16 and 17: Production of Photoreceptors 16 and 17

A photoreceptor 17 was produced in the same manner as in the production of the photoreceptor 10 except that the radically polymerizable monomer was changed to M5 and the radically polymerizable PFPE was changed to P-7A. In addition, a photoreceptor 16 was produced in the same manner as in the production of the photoreceptor 17 except that the amount of the metal oxide fine particles added was changed to 170 parts by mass.

Example 18: Production of Photoreceptor 18

A photoreceptor 18 was produced in the same manner as in the production of the photoreceptor 17 except that the radically polymerizable PFPE was changed to P-8A.

Example 19: Production of Photoreceptor 19

A photoreceptor 19 was produced in the same manner as in the production of the photoreceptor 17 except that the amount of the radically polymerizable monomer added was changed to 130 parts by mass and the radically polymerizable PFPE was changed to P-9M and the added amount thereof was changed to 20 parts by mass.

Example 20: Production of Photoreceptor 20

A photoreceptor 20 was produced in the same manner as in the production of the photoreceptor 7 except that the radically polymerizable PFPE was changed to the Fluorolink MD700 (manufactured by Solvay Specialty Polymers, also referred to as "MD700") and the amount of the metal oxide fine particles added was changed to 60 parts by mass.

Example 21: Production of Photoreceptor 21

A photoreceptor 21 was produced in the same manner as in the production of the photoreceptor 10 except that the radically polymerizable PFPE was changed to the Fomblin MT70 (manufactured by Solvay Specialty Polymers, also referred to as "MT70").

Example 22: Production of Photoreceptor 22

A photoreceptor 22 was produced in the same manner as in the production of the photoreceptor 12 except that the radically polymerizable monomer was changed to M5, the radically polymerizable PFPE was changed to the Fluorolink AD1700 (manufactured by Solvay Specialty Polymers, also referred to as "AD1700"), and the amount of the metal oxide fine particles added was changed to 50 parts by mass.

Example 23: Production of Photoreceptor 23

A photoreceptor 23 was produced in the same manner as in the production of the photoreceptor 1 except that the radically polymerizable monomer was changed to M2 and the added amount thereof was changed to 90 parts by mass, the amount of the radically polymerizable PFPE added was changed to 60 parts by mass, and the metal oxide fine particles were changed to the metal oxide fine particles 2.

Examples 24 and 25: Production of Photoreceptors 24 and 25

A photoreceptor 24 was produced in the same manner as in the production of the photoreceptor 6 except that the metal oxide fine particles were changed to the metal oxide fine particles 2 and the added amount thereof was changed to 80 parts by mass. In addition, a photoreceptor 25 was produced in the same manner as in the production of the photoreceptor 24 except that the amount of the metal oxide fine particles added was changed to 120 parts by mass.

Example 26: Production of Photoreceptor 26

A photoreceptor 26 was produced in the same manner as in the production of the photoreceptor 17 except that the radically polymerizable PFPE was changed to P-9M and the metal oxide fine particles were changed to the metal oxide fine particles 2.

Examples 27 and 28: Production of Photoreceptors 27 and 28

A photoreceptor 27 was produced in the same manner as in the production of the photoreceptor 10 except that the radically polymerizable PFPE was changed to MT70 and the metal oxide fine particles were changed to the metal oxide fine particles 2. In addition, a photoreceptor 28 was produced in the same manner as in the production of the photoreceptor 27 except that the metal oxide fine particles were changed to the metal oxide fine particles 3.

Comparative Example 1: Production of Photoreceptor C1

A photoreceptor C1 was produced in the same manner as in the production of the photoreceptor 19 except that the radically polymerizable monomer was changed to M1, and the radically polymerizable PFPE (P-9M) was changed to the Fomblin D2 (manufactured by Solvay Specialty Polymers, also referred to as "D2").

Comparative Example 2: Production of Photoreceptor C2

A photoreceptor C2 was produced in the same manner as in the production of the photoreceptor 18 except that the metal oxide fine particles were changed to the metal oxide fine particles 4.

Comparative Example 3: Production of Photoreceptor C3

A photoreceptor C3 was produced in the same manner as in the production of the photoreceptor 22 except that the metal oxide fine particles were changed to the metal oxide fine particles 4.

[Evaluation]

The respective photoreceptors 1 to 28 and C1 to C3 were subjected to a durability test in which the photoreceptors were mounted on a full-color copying machine (trade name: "bizhub PRO C6501" manufactured by Konica Minolta, Inc., "bizhub" is a registered trademark of the company) and a character image having an image ratio of 6% was continuously printed by 500,000 sheets in the direction to transversely send A4 paper in a high-temperature and high-humidity environment (HH environment) at 30° C. and 85% RH.

(1) Wear Resistance

The film thickness was randomly measured at 10 places having a uniform film thickness (excluding at least the places at 3 cm from both ends since both ends of the photoreceptor is likely to have an uneven film thickness) of the photoreceptor before and after the durability test by using an eddy current type film thickness measuring apparatus (trade name: "EDDY560C" manufactured by HELMUT FISCHER GMBTE CO), and the average value thereof was calculated and adopted as the film thickness of the photoreceptor. Moreover, the difference in film thickness of the photoreceptor before and after the durability test was adopted as the worn amount. The wear resistance is higher as the worn amount is smaller, and there is no practical problem when the worn amount is 2.0 μm or less.

(2) Scratch Resistance

After the durability test described above, it was performed to image a halftone image on the entire surface of A3 paper and the scratch resistance of the photoreceptor was evaluated according to the following criteria.

A: Generation of visually observable noticeable scratches on the surface of the photoreceptor is not found and formation of a defective image corresponding to the photoreceptor scratch on the halftone image is also not found (favorable).

B: Generation of visually observable minor scratches on the surface of the photoreceptor is found but formation of a defective image corresponding to the photoreceptor scratch on the halftone image is not found (no practical problem).

C: Generation of visually observable clear scratches on the surface of the photoreceptor is found and formation of a defective image corresponding to the photoreceptor scratch on the halftone image is also found (practical problems).

(3) Cleaning Property

During and after the durability test, the surface of the photoreceptor was visually observed and the cleaning property of the photoreceptor was evaluated according to the following criteria.

A: Level in which slipping of the toner is not observed until the 500,000th sheet and there is no problem at all.

B: Level in which slipping of the toner is partially observed on the photoreceptor at the time of being the 500,000th sheet, but the output image is favorable, thus there is no practical problem.

C: Level in which generation of a streak-like minor image defect is observed on the output image before the 500,000th sheet by slipping of the toner, but there is no practical problem.

D: Level in which generation of a streak-like clear image defect is observed on the output image before the 500,000th sheet by slipping of the toner (practical problems).

The composition of the materials for the protective layer in the respective photoreceptors are shown in Table 1 and Table 2. In addition, the evaluation results for the respective photoreceptors are shown in Table 3. In the following Tables, the term "monomer" denotes a radically polymerizable monomer, the term "PFPE" denotes a PFPE containing a radically polymerizable PFPE, and the term "MOP" denotes metal oxide fine particles. In addition, in the following Tables, the "ratio of PFPE" is determined by the following equation (1) and the "ratio of MOP" is determined by the following equation (2).

ratio of PFPE=(amount of PFPE added)/(amount of monomer added)×100 Equation (1):

ratio of MOP=(amount of MOP added)/{(amount of PFPE added)+(amount of monomer added)}×100. Equation (2):

TABLE 1

| | Monomer | | PEPE | | | MOP | | | |
|---|---|---|---|---|---|---|---|---|---|
| | Kind | Added amount (parts by mass) | Kind | Number of functional groups | Added amount (parts by mass) | NO. | Added amount (parts by mass) | Ratio of PFPE (—) | Ratio of MOP (—) |
| Example 1 | M1 | 120 | P-2M | 2 | 30 | 1 | 100 | 25 | 67 |
| Example 2 | M2 | 120 | P-2A | 2 | 30 | 1 | 100 | 25 | 67 |
| Example 3 | M2 | 120 | P-3M | 4 | 30 | 1 | 100 | 25 | 67 |
| Example 4 | M11 | 100 | P-4A | 6 | 50 | 1 | 100 | 50 | 67 |
| Example 5 | M1 | 120 | P-5A | 4 | 30 | 1 | 100 | 25 | 67 |
| Example 6 | M1 | 120 | P-6A | 4 | 30 | 1 | 100 | 25 | 67 |
| Example 7 | M1 | 140 | P-6M | 4 | 10 | 1 | 100 | 7 | 67 |
| Example 8 | M1 | 136 | P-6M | 4 | 14 | 1 | 100 | 10 | 67 |
| Example 9 | M1 | 125 | P-6M | 4 | 25 | 1 | 100 | 20 | 67 |
| Example 10 | M1 | 100 | P-6M | 4 | 50 | 1 | 100 | 50 | 67 |
| Example 11 | M1 | 90 | P-6M | 4 | 60 | 1 | 100 | 67 | 67 |
| Example 12 | M1 | 75 | P-6M | 4 | 75 | 1 | 100 | 100 | 67 |
| Example 13 | M1 | 70 | P-6M | 4 | 80 | 1 | 100 | 114 | 67 |
| Example 14 | M1 | 100 | P-6M | 4 | 50 | 1 | 45 | 50 | 30 |
| Example 15 | M1 | 100 | P-6M | 4 | 50 | 1 | 150 | 50 | 100 |

TABLE 2

| | Monomer | | PEPE | | | MOP | | | |
|---|---|---|---|---|---|---|---|---|---|
| | Kind | Added amount (parts by mass) | Kind | Number of functional groups | Added amount (parts by mass) | NO. | Added amount (parts by mass) | Ratio of PFPE (—) | Ratio of MOP (—) |
| Example 16 | M5 | 100 | P-7A | 4 | 50 | 1 | 170 | 50 | 113 |
| Example 17 | M5 | 100 | P-7A | 4 | 50 | 1 | 100 | 50 | 67 |
| Example 18 | M5 | 100 | P-8A | 2 | 50 | 1 | 100 | 50 | 67 |
| Example 19 | M5 | 130 | P-9M | 2 | 20 | 1 | 100 | 15 | 67 |
| Example 20 | M1 | 140 | MD700 | 2 | 10 | 1 | 60 | 7 | 40 |
| Example 21 | M1 | 100 | MT70 | 4 | 50 | 1 | 100 | 50 | 67 |
| Example 22 | M5 | 75 | AD1700 | 4 | 75 | 1 | 50 | 100 | 33 |
| Example 23 | M2 | 90 | P-2M | 4 | 60 | 2 | 100 | 67 | 67 |
| Example 24 | M1 | 120 | P-6A | 4 | 30 | 2 | 80 | 25 | 53 |
| Example 25 | M1 | 120 | P-6A | 4 | 30 | 2 | 120 | 25 | 80 |
| Example 26 | M5 | 100 | P-9M | 2 | 50 | 2 | 100 | 50 | 67 |
| Example 27 | M1 | 100 | MT70 | 4 | 50 | 2 | 100 | 50 | 67 |
| Example 28 | M1 | 100 | MT70 | 4 | 50 | 3 | 100 | 50 | 67 |
| Comparative Example 1 | M1 | 130 | D2 | 0 | 20 | 1 | 100 | 15 | 67 |
| Comparative Example 2 | M5 | 100 | P-8A | 2 | 50 | 4 | 100 | 50 | 67 |
| Comparative Example 3 | M5 | 75 | AD1700 | 4 | 75 | 4 | 50 | 100 | 33 |

TABLE 3

| | Worn amount (μm) | Scratch resistance | Cleaning property |
|---|---|---|---|
| Example 1 | 1.2 | B | C |
| Example 2 | 0.7 | A | C |
| Example 3 | 0.6 | A | A |
| Example 4 | 0.7 | A | A |
| Example 5 | 0.5 | A | A |
| Example 6 | 0.7 | A | A |

TABLE 3-continued

| | Worn amount (μm) | Scratch resistance | Cleaning property |
|---|---|---|---|
| Example 7 | 0.9 | A | C |
| Example 8 | 0.6 | A | B |

TABLE 3-continued

| | Worn amount (μm) | Scratch resistance | Cleaning property |
|---|---|---|---|
| Example 9 | 0.6 | A | A |
| Example 10 | 0.6 | A | A |
| Example 11 | 0.8 | A | A |
| Example 12 | 1.1 | A | A |
| Example 13 | 1.6 | B | A |
| Example 14 | 1.8 | B | A |

TABLE 3-continued

| | Worn amount (μm) | Scratch resistance | Cleaning property |
|---|---|---|---|
| Example 15 | 0.5 | A | B |
| Example 16 | 0.5 | A | C |
| Example 17 | 0.8 | A | A |
| Example 18 | 0.7 | A | C |
| Example 19 | 1.4 | B | C |
| Example 20 | 1.2 | B | C |
| Example 21 | 0.9 | A | A |
| Example 22 | 1.8 | B | B |
| Example 23 | 0.8 | A | A |
| Example 24 | 0.7 | A | A |
| Example 25 | 1.0 | A | A |
| Example 26 | 1.3 | A | C |
| Example 27 | 0.8 | A | A |
| Example 28 | 0.7 | A | A |
| Comparative Example 1 | 2.2 | C | D |
| Comparative Example 2 | 2.7 | B | D |
| Comparative Example 3 | 3.4 | C | C |

As shown in Tables 1 to 3, the photoreceptors 1 to 28 have a sufficiently small worn amount and exhibit sufficient scratch resistance and cleaning property. Consequently, it can be seen that an electrophotographic photoreceptor which is formed by superimposing a photosensitive layer and a protective layer on a conductive support in this order and in which the protective layer is formed of a polymerized and cured product of a radically polymerizable composition containing a radically polymerizable monomer, a radically polymerizable PFPE, and radically polymerizable metal oxide fine particles exhibits excellent wear resistance, scratch resistance, and cleaning property.

In addition, from the photoreceptors 2 to 4, it can be seen that it is preferable that the radically polymerizable PFPE is a PFPE having 4 or more radically polymerizable groups from the viewpoint of enhancing the cleaning property.

In addition, from the photoreceptors 7 to 13, it can be seen that it is preferable that the content of PFPE in the polymerized and cured product is from 10 to 100 parts by mass in terms of the content of the radically polymerizable PFPE with respect to 100 parts by mass of the radically polymerizable monomer in the radically polymerizable composition from the viewpoint of enhancing the wear resistance, the scratch resistance, and the cleaning property.

In addition, from the photoreceptors 12, 14 and 15, it can be seen that it is preferable that the content of the metal oxide fine particles in the polymerized and cured product is from 30 to 100 parts by mass in terms of the content of the radically polymerizable metal oxide fine particles with respect to 100 parts by mass of the sum of the radically polymerizable monomer and the radically polymerizable PFPE in the radically polymerizable composition from the viewpoint of enhancing the scratch resistance and the cleaning property.

In contrast, the photoreceptor C1 exhibits insufficient wear resistance, scratch resistance, and cleaning property. It is believed that this is because the PFPE does not have a radically polymerizable group, the PFPE is thus unevenly distributed on the surface of the protective layer, and the effect by the PFPE is impaired during the durability test.

The photoreceptor C2 exhibits insufficient cleaning property and has a great worn amount and the photoreceptor C3 exhibits insufficient scratch resistance and has a great worn amount. It is believed that this is because the surface-treated metal oxide fine particles do not have a radically polymerizable group, the effect by dispersion and immobilization of the PFPE into the inside of the protective layer is insufficient in the photoreceptor C2, and the mechanical strength of the protective layer is insufficient in the photoreceptor C3.

According to an embodiment of the present invention, it is possible to enhance the wear resistance, scratch resistance, and cleaning property of an electrophotographic photoreceptor for an electrophotographic image forming apparatus, and the electrophotographic photoreceptor can exert these properties over a long period of time. Consequently, according to an embodiment of the present invention, further enhancement of durability and further diffusion of an electrophotographic image forming apparatus can be expected.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An electrophotographic photoreceptor comprising:

a conductive support;

a photosensitive layer disposed on the conductive support; and a protective layer disposed on the photosensitive layer, wherein the protective layer is formed of a polymerized and cured product of a radically polymerizable composition containing a radically polymerizable monomer, a perfluoropolyether compound having a first radically polymerizable group, and metal oxide fine particles having a second radically polymerizable group, and the metal oxide fine particles are surface-treated with a compound having the second radically polymerizable group.

2. The electrophotographic photoreceptor according to claim 1, wherein the perfluoropolyether compound has 4 or more radically polymerizable groups.

3. The electrophotographic photoreceptor according to claim 1, wherein a content of the perfluoropolyether compound in the polymerized and cured product is from 10 to 100 parts by mass in terms of a content of the perfluoropolyether compound having the first radically polymerizable group with respect to 100 parts by mass of the radically polymerizable monomer in the radically polymerizable composition.

4. The electrophotographic photoreceptor according to claim 1, wherein a content of the metal oxide fine particles in the polymerized and cured product is from 30 to 100 parts by mass in terms of a content of the metal oxide fine particles having the second radically polymerizable group with respect to 100 parts by mass of a sum of the radically polymerizable monomer and the perfluoropolyether compound having the first radically polymerizable group in the radically polymerizable composition.

5. The electrophotographic photoreceptor according to claim 1, wherein the first and second radically polymerizable groups are the same.

6. The electrophotographic photoreceptor according to claim wherein the first and second radically polymerizable groups are different.

* * * * *